US009939774B2

(12) United States Patent
Agata

(10) Patent No.: US 9,939,774 B2
(45) Date of Patent: Apr. 10, 2018

(54) CONNECTION MECHANISM AND IMAGE FORMING APPARATUS

(71) Applicant: CANON KABUSHIKI KAISHA, Tokyo (JP)

(72) Inventor: Jun Agata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/296,923

(22) Filed: Oct. 18, 2016

(65) Prior Publication Data

US 2017/0038726 A1 Feb. 9, 2017

Related U.S. Application Data

(63) Continuation of application No. 14/165,927, filed on Jan. 28, 2014, now Pat. No. 9,501,029.

(30) Foreign Application Priority Data

Jan. 31, 2013 (JP) ..... 2013-017481

(51) Int. Cl.
*G03G 15/00* (2006.01)
*G03G 21/16* (2006.01)

(52) U.S. Cl.
CPC ..... *G03G 21/1647* (2013.01); *G03G 21/1604* (2013.01); *G03G 15/6582* (2013.01); *G03G 21/1619* (2013.01); *G03G 2221/1654* (2013.01); *G03G 2221/1696* (2013.01); *Y10T 403/602* (2015.01)

(58) Field of Classification Search
CPC ..... Y10T 403/60; G03G 21/1647; G03G 21/1604; G03G 21/1619; G03G 21/1654; G03G 21/1699
USPC ..... 399/406–410; 312/217
See application file for complete search history.

(56) References Cited

U.S. PATENT DOCUMENTS 7,431,287 B2 * 10/2008 Hayashi ..... B65H 1/26 271/162
7,469,892 B2 * 12/2008 Iwase ..... G03G 15/6502 271/145
2002/0014817 A1 * 2/2002 Lammens ..... E05B 65/464 312/217
2004/0264998 A1 * 12/2004 Uchida ..... G03G 15/6511 399/107
2007/0294893 A1 * 12/2007 Chou ..... A45F 5/00 30/28
2012/0141158 A1 * 6/2012 Yamauchi ..... G03G 21/1695 399/110

(Continued)

FOREIGN PATENT DOCUMENTS

JP 2001-125329 A 5/2001
JP 2011-053281 A 3/2011

*Primary Examiner* — Walter L Lindsay, Jr.
*Assistant Examiner* — Arlene Heredia Ocasio
(74) *Attorney, Agent, or Firm* — Canon U.S.A., Inc. IP Division

(57) ABSTRACT

A connection mechanism includes a connecting portion including a rotation arm rotatable around a rotation shaft, an urging unit configured to urge the rotation arm, and an engagement pin provided on the rotation arm; and a connected portion having an engagement groove formed in a tapered shape in an urging direction of the urging unit so as to allow entering of the engagement pin and holding of the engagement pin by the urging force of the urging unit.

16 Claims, 10 Drawing Sheets

(56) References Cited

U.S. PATENT DOCUMENTS

| | | | | |
|---|---|---|---|---|
| 2013/0230335 | A1* | 9/2013 | Hiura | G03G 15/6505 399/110 |
| 2015/0130341 | A1* | 5/2015 | Azami | G03G 21/1623 312/333 |

* cited by examiner

CONNECTION MECHANISM AND IMAGE FORMING APPARATUS

CROSS-REFERENCE TO RELATED APPLICATION

This application is a Continuation of U.S. application Ser. No. 14/165,927, filed Jan. 28, 2014, which claims priority from Japanese Patent Application No. 2013-017481 filed Jan. 31, 2013, which is hereby incorporated by reference herein in its entirety.

BACKGROUND OF THE INVENTION

Field of the Invention

The present invention relates to a connection mechanism for connecting apparatuses to each other and an image forming apparatus including the connection mechanism.

Description of the Related Art

Conventionally, there has been known an image forming apparatus including a sheet post-processing apparatus for performing sort processing on a predetermined number of sheets on which images have been formed by an image forming apparatus main body and for performing post-processing, such as punching and stapling.

Generally, the sheet post-processing apparatus is separably connected to the image forming apparatus main body by a connection mechanism. Such a configuration is usable for facilitating a jam handling process at the connection portion between the post-processing apparatus and the image forming apparatus main body. As discussed in Japanese Patent Application Laid-Open No. 09-295758, in the connection mechanism, a shaft to be locked is provided on the image forming apparatus main body side, and a rotatable hook is provided on the sheet post-processing apparatus side. The image forming apparatus main body and the sheet post-processing apparatus are generally connected to each other by setting the hook on the shaft to be locked. In the connection mechanism discussed in Japanese Patent Application Laid-Open No. 09-295758, however, the transfer of sheets becomes unstable due to play and clearance provided to the hook side, resulting in deterioration in the precision of the post-processing operation, such as punching and stapling. Further, the transfer of sheets from the sheet feeding apparatus becomes unstable in an image forming apparatus to which a sheet feeding apparatus capable of storing a large amount of sheets and a sheet feeding apparatus including a plurality of feeding cassettes are connected, resulting in deterioration in image precision.

SUMMARY OF THE INVENTION

The present invention is directed to a connection mechanism capable of connecting apparatuses stably to each other and an image forming apparatus including the same.

According to an aspect of the present invention, a connection mechanism includes a connecting portion including a rotation arm rotatable around a rotation shaft, an urging unit configured to urge the rotation arm, and an engagement pin provided on the rotation arm; and a connected portion having an engagement groove formed in a tapered shape in an urging direction of the urging unit so as to allow entering of the engagement pin and holding of the engagement pin.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

An image forming apparatus according to the present invention is a copying machine, a printer, a facsimile, and a multifunction peripheral including the same. In the exemplary embodiment described below, a color multifunction peripheral (hereinafter simply referred to as the multifunction peripheral) 100 is taken as an example of the image forming apparatus.

Figure 1:
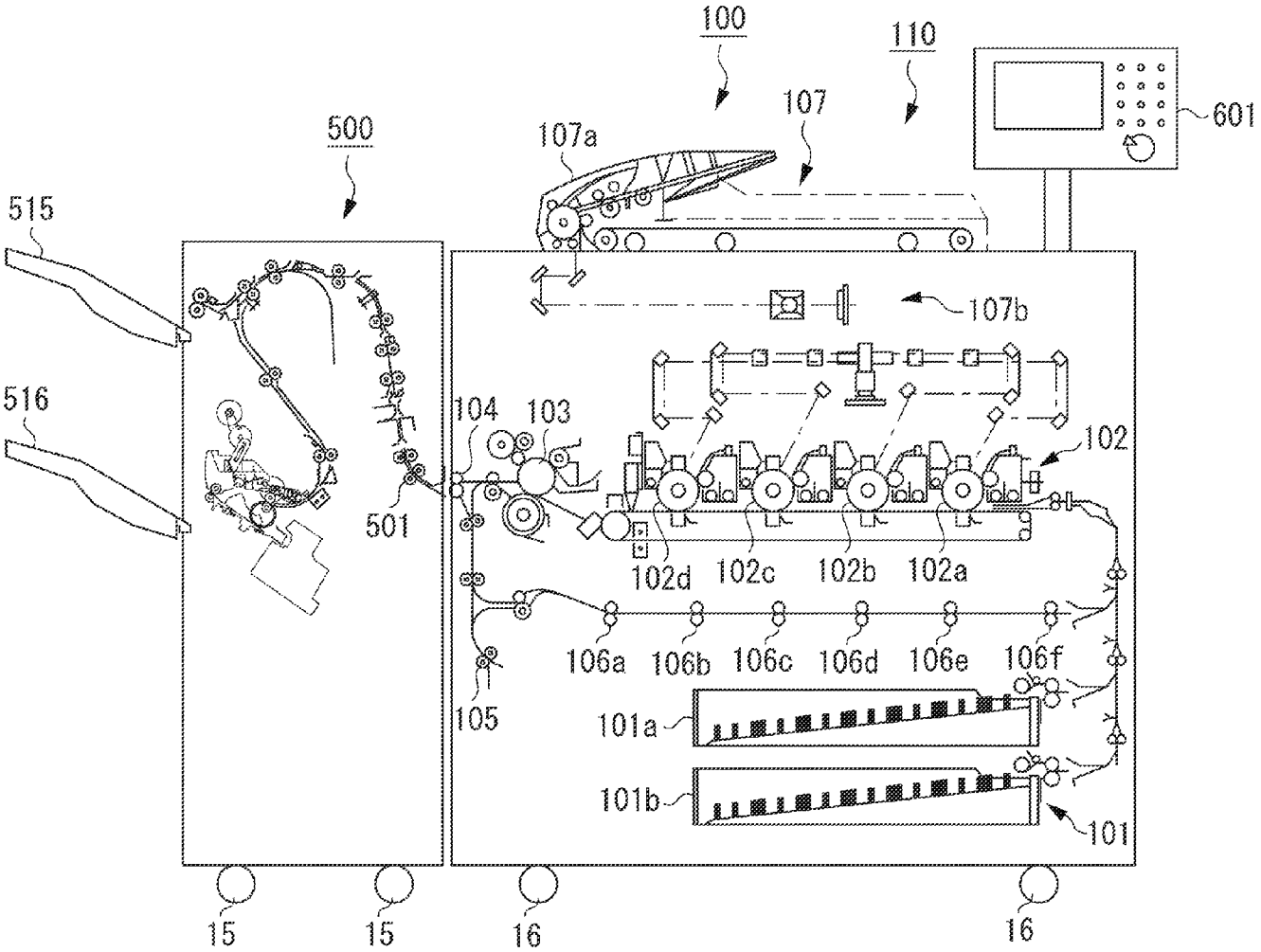
FIG. 1 is a sectional view schematically illustrating an overall configuration of a multifunction peripheral according to a first exemplary embodiment of the present invention.

The multifunction peripheral 100 according to the first exemplary embodiment of the present invention will be described with reference to FIGS. 1 through 8A, 8B, 8C, and 8D. First, the overall construction of the multifunction peripheral 100 according to the first exemplary embodiment will be described with reference to FIG. 1. FIG. 1 is a sectional view schematically illustrating the overall construction of the multifunction peripheral 100 according to the first exemplary embodiment of the present invention.

As illustrated in FIG. 1, the multifunction peripheral 100 includes a printer 110 serving as the image forming apparatus main body for forming an image on a sheet, and a finisher 500 serving as the sheet post-processing apparatus (the connected apparatus) for performing sheet post-processing.

The finisher 500 is detachably connected to the printer 110 by a connection mechanism 10 (See FIG. 4) described below, and can be used as an option with respect to the printer 110 that can be singly used. The connection mechanism 10 will be described in detail below. In the following, a side of a position where a user faces an operation unit 601 for performing various input and setting operations on the multifunction peripheral 100 will be referred to as a "front side", and a opposite side of front side will be referred to as the "back side". That is, FIG. 1 is a sectional view illustrating the inner structure of the multifunction peripheral 100 as viewed from the front side, and the finisher 500 is connected to a side portion of the printer 110.

The printer 110 includes a sheet feeding unit 101 for feeding sheets, an image forming unit 102 for forming images on sheets, a discharge roller pair 104 for sending the sheets on which images have been formed to the finisher 500, and an image reading apparatus 107 for reading the images of documents.

The image reading apparatus 107 includes a document feeding unit 107*a* for automatically feeding documents, and a document reading unit 107*b* for reading the documents. Image Information of the documents read by the document reading unit 107*b* is sent to the image forming unit 102. The image forming unit 102 includes photosensitive drums 102*a* through 102*d* on which yellow, magenta, cyan, and black toner images are formed, respectively. Toner images of each of the different colors based on the image information read by the document reading unit 107*b* are formed on the photosensitive drums 102*a* through 102*d*. The sheet feeding unit 101 includes feeding cassettes 101*a* and 101*b* for storing sheets, and the sheets stored in the feeding cassettes 101*a* and 101*b* are fed one by one to the image forming unit 102 with a predetermined timing, in parallel with the toner image forming operation.

When a sheet is fed to the image forming unit 102, the toner images of the different colors formed on the photosensitive drums 102*a* through 102*d* are successively transferred in a superimposing manner, and an unfixed toner image is formed on the sheet. After this, the unfixed toner image is fixed at a fixing unit 103, and the sheet is sent into the finisher 500 by the discharge roller pair 104. In the case of two-sided printing, the sheet is reversed by a reversing roller 105, and then the sheet reversed is conveyed again to the image forming unit 102 by conveyance rollers 106*a* through 106*f* provided in the reverse conveyance path before repeating the above-described operation.

The finisher 500 takes in a plurality of sheets sent in from the printer 110 by a conveyance roller 501, and performs a predetermined post-processing operation before stacking them on one of an upper stacking tray 515 and a lower stacking tray 516 provided on a side surface of the finisher 500. Examples of the predetermined post-processing operation include alignment, folding, punching, and stapling processing.

Next, the connection mechanism 10 for connecting the printer 110 and the finisher 500 to each other will be described with reference to FIGS. 2A and 2B through 8A, 8B, 8C, and 8D. The construction of the connection mechanism 10 will be described with reference to FIGS. 2A and 2B through 7A, 7B, and 7C.

Figure 2A:
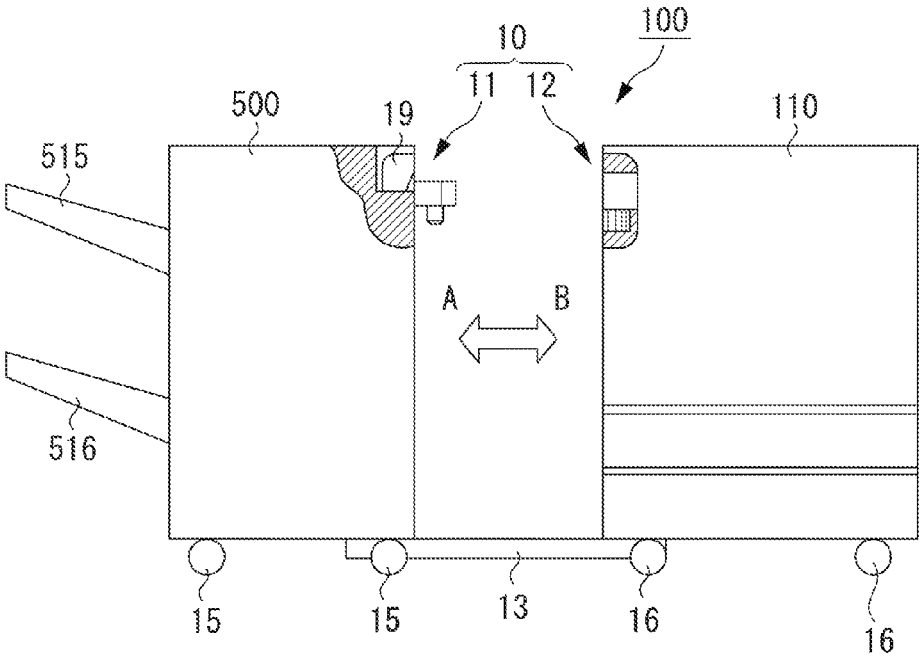
FIGS. 2A and 2B are diagrams schematically illustrating a state in which a printer according to the first exemplary embodiment is separated from a finisher.
Figure 2B:
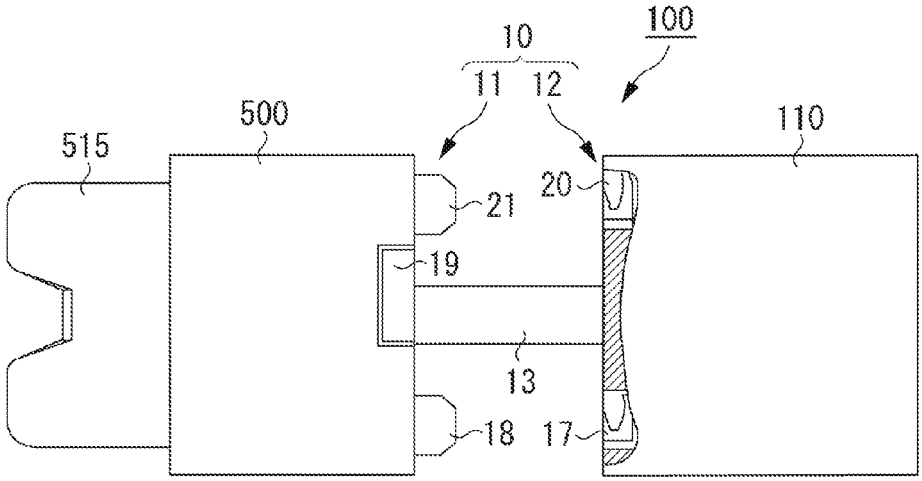
Figure 3:
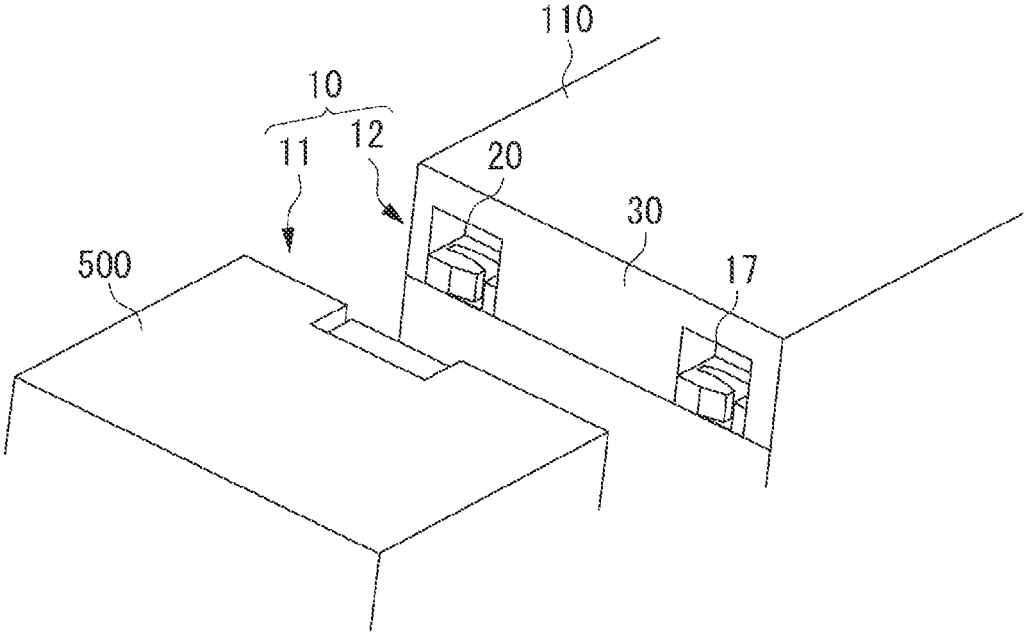
FIG. 3 is a perspective view of the printer and the finisher viewed from above illustrated in FIGS. 2A and 2B.
Figure 5:
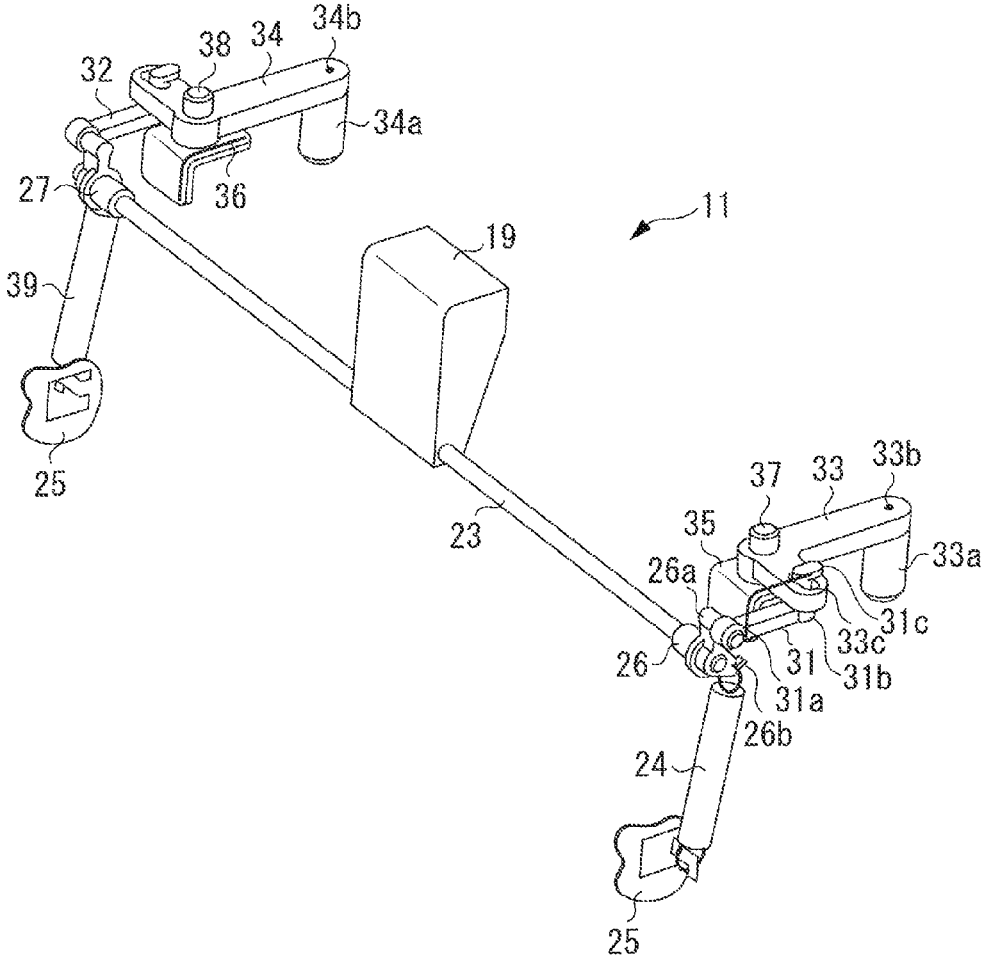
FIG. 5 is a perspective view of a connecting portion according to the first exemplary embodiment with a first engagement block and a second engagement block removed therefrom.
Figure 6:
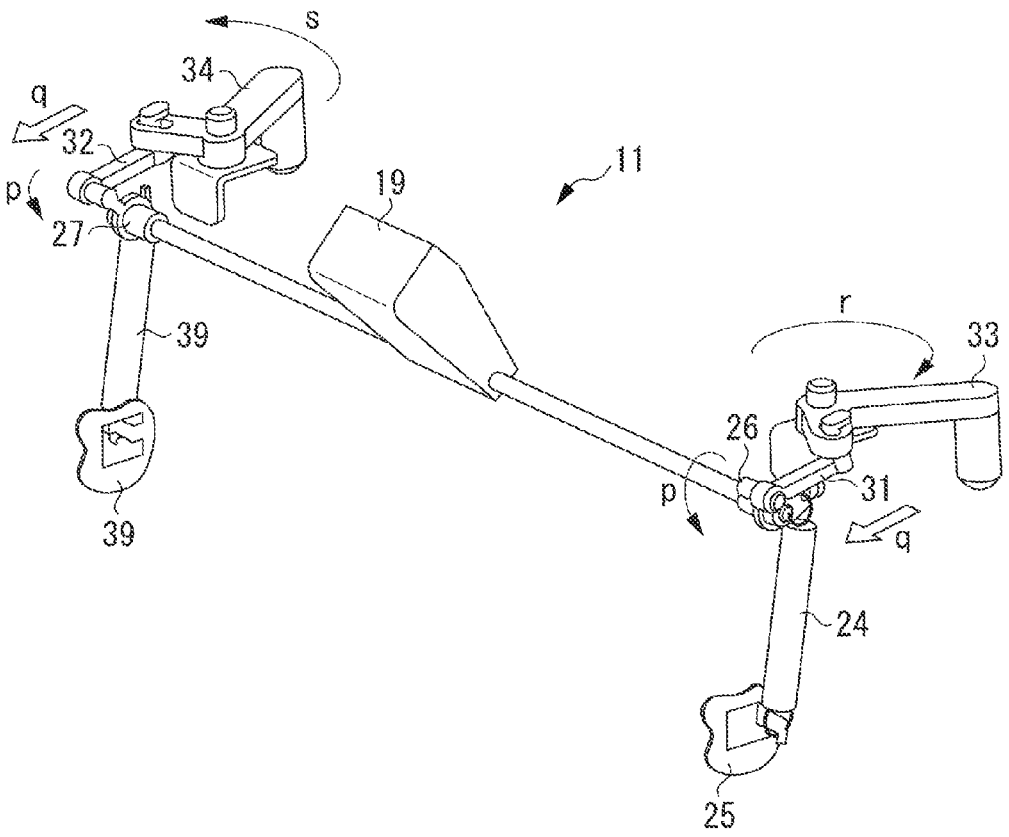
FIG. 6 is a perspective view illustrating a releasing operation performed on a connected portion by the connecting portion according to the first exemplary embodiment.
Figure 7A:
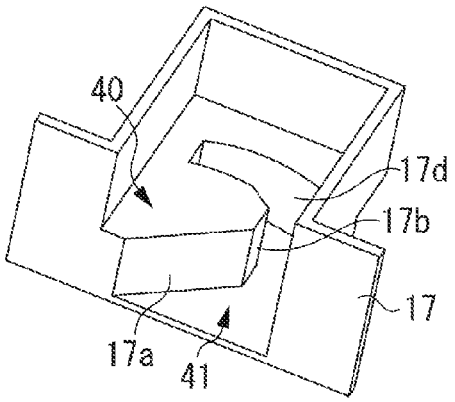
FIGS. 7A, 7B, and 7C are diagrams illustrating a first pin housing of the connected portion according to the first exemplary embodiment.
Figure 7B:
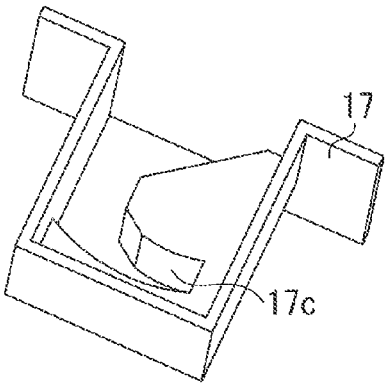
Figure 7C:
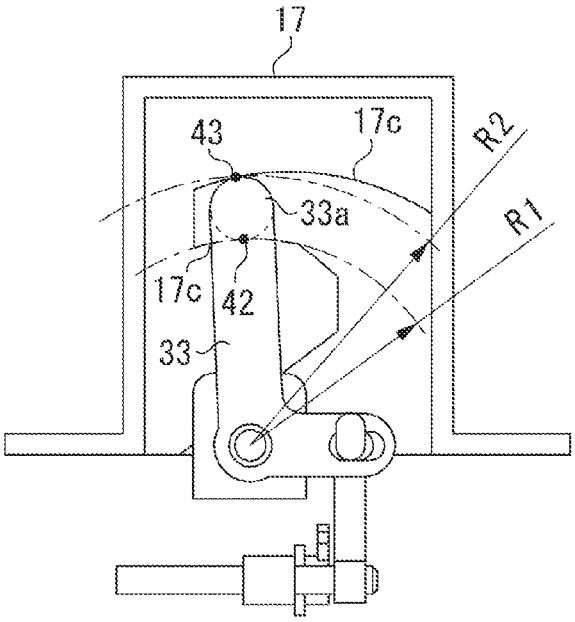

FIGS. 2A and 2B are diagrams schematically illustrating a state in which the finisher 500 has been separated from the printer 110 according to the first exemplary embodiment. FIG. 3 is a perspective view, as viewed from above, of the printer 110 and the finisher 500 illustrated in FIGS. 2A and 2B. FIG. 4 is a diagram illustrating the connection mechanism 10 of the multifunction peripheral 100 according to the first exemplary embodiment. FIG. 5 is a perspective view of the connecting portion 11 according to the first exemplary embodiment with a first engagement block 28 and a second engagement block 29 removed therefrom. FIG. 6 is a perspective view illustrating a releasing operation of a connecting portion 11 with respect to a connected portion 12 according to the first exemplary embodiment. FIGS. 7A, 7B, and 7C are diagrams illustrating a first pin housing 17 of the connected portion 12 according to the first exemplary embodiment. In FIGS. 2A, 2B, and 3, the image reading apparatus 107 illustrated in FIG. 1 is not illustrated.

As illustrated in FIGS. 2A and 2B, casters 16 are provided at the bottom portion of the printer 110, and the printer 110 can be fixed in position with respect to the floor surface by an adjuster (not illustrated) to prevent the casters 16 from rotating. The finisher 500 is connected to the printer 110 via a guide rail 13 that is extendable, and is movable on casters 15 provided at the bottom portion of the finisher 500 in direction A (separating direction) and in direction B (connecting direction) illustrated in FIG. 2A. The moving direction in which the finisher 500 can moves is restricted by the guide rail 13, whereby reconnection can be easily performed after separation.

As illustrated in FIGS. 2A, 2B, and 3, the connection mechanism 10 includes the connecting portion 11 provided on the finisher 500 and the connected portion 12 provided on the printer 110. As illustrated in FIGS. 4 and 5, the connecting portion 11 includes a first locking unit 18 provided on the front side of the finisher 500, a second locking unit 21 provided on the back side of the finisher 500, and a releasing lever 19.

The first locking unit 18 includes the first engagement block 28 as a casing member, a first rotation arm 33 as a rotation arm, a first engagement pin 33*a* as an engagement pin, and a first return spring 24 as an urging portion.

The first engagement block 28 is formed so as to be capable of accommodating the first rotation arm 33 with the first engagement pin 33*a* exposed, and is fixed to a stay (not illustrated) provided inside the finisher 500. As illustrated in FIG. 5, the first rotation arm 33 is formed in a substantially L-shaped configuration, and is rotatably supported by a support pin 37 as a rotation shaft. The support pin 37 is supported by a pin base 35 fixed to the stay (not illustrated).

At one side of end portions of the first rotation arm 33, the first engagement pin 33*a* is supported so as to be rotatable around a center axis (center line) 33*b* parallel to the support pin 37, and the first engagement pin 33*a* is formed by a columnar roller member. At the other side of the end portion of the first rotation arm 33, a swing hole 33*c* is formed. The swing hole 33*c* is formed as an elongated hole extending from the front to the back side. Inserted into the swing hole 33*c* is a connection shaft 31*b* provided at one end portion of a first link 31. At the end of the connection shaft 31*b*, a tab 31*c* is formed. The tab 31*c* prevents the first link 31 from falling from the swing hole 33*c*. At the other side of the end portion of the first link 31, a rotation hole 31*a* is formed. The rotation hole 31*a* rotatably supports a link shaft 26*a* formed protrusively from the outer peripheral portion of a first arm bush 26. Further, a hook 26*b* is formed at the outer peripheral portion of the first arm bush 26, and one end portion of the first return spring 24 is connected to the hook 26*b*. The other end portion of the first return spring 24 is connected to a spring hook 25 formed on a side plate (not illustrated) of the finisher 500. The position as illustrated in FIG. 5 is the initial position for the first rotation arm 33 connected as described above.

The second locking unit 21 includes the second engagement block 29 as a casing member, a second rotation arm 34 as a rotation arm, a second engagement pin 34*a* as an engagement pin, and a second return spring 39 as an urging unit. The second locking unit 21 is configured by components that are symmetrical with those of the first locking unit 18, so that a concrete description of the components thereof will be omitted.

The releasing lever 19 is fixed to a substantially central portion of a releasing shaft 23 connected to the first arm bush 26 and the second arm bush 27, and rotates the first rotation arm 33 and the second rotation arm 34 against the urging force of the first return spring 24 and the second return spring 39. Specifically, as illustrated in FIG. 6, when the releasing lever 19 is rotated in the direction of arrows p in FIG. 6, the first arm bush 26 and the second arm bush 27 rotate in the direction of the arrows p, and the first link 31 and the second link 32 move in the direction of arrows q. When the first link 31 and the second link 32 move in the direction of the arrows q, the first rotation arm 33 rotates in the direction of an arrow r, and the second rotation arm 34 rotates in the direction of an arrow s. When the releasing lever 19 is released, the first rotation arm 33 and the second rotation arm 34 return to the initial position due to the urging force of the first return spring 24 and the second return spring 39.

Figure 4A:
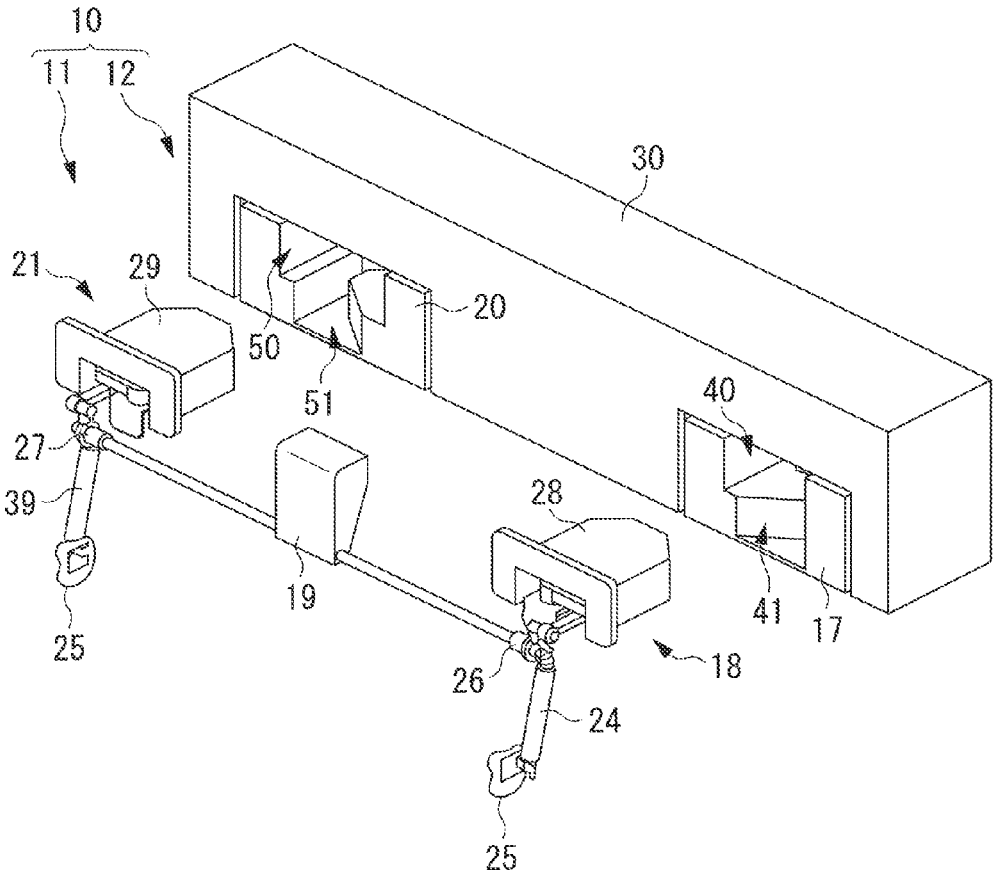
FIGS. 4A and 4B are diagrams illustrating a connection mechanism of the multifunction peripheral according to the first exemplary embodiment.
Figure 4B:
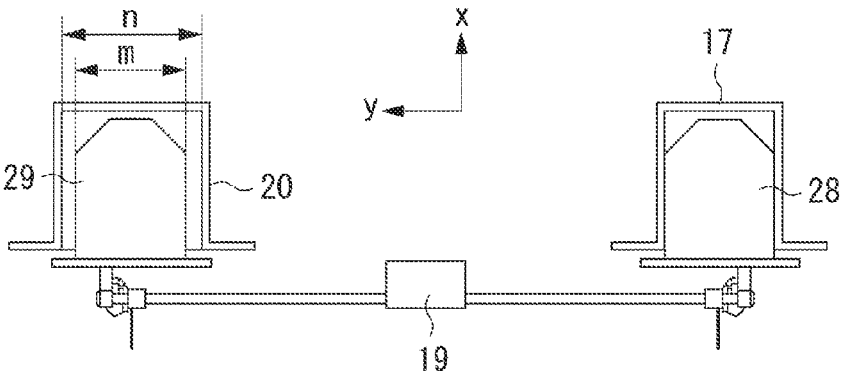

As illustrated in FIG. 4A, the connected portion 12 includes a first pin housing 17 arranged opposite the first locking unit 18, and a second pin housing 20 arranged opposite the second locking unit 21. The first pin housing 17 and the second pin housing 20 are fixed to a top cover 30 arranged on the top portion of the printer 110 (See FIG. 3).

The first pin housing 17 has a first insertion hole 40 as a recess portion allowing insertion of the first engagement block 28, and a first engagement groove 41 as an engagement groove for engaging with the first engagement pin 33*a*. The first insertion hole 40 is formed so as to allow insertion of the first engagement block 28 without any gap. By inserting the first engagement block 28, positioning of the connecting portion 11 is performed with respect to the connected portion 12 in a width direction y illustrated in FIG. 4B (See FIG. 4B).

As illustrated in FIGS. 7A and 7B, the first engagement groove 41 has a guide surface 17*a* and an introduction surface 17*b* for guiding the first engagement pin 33*a* to an engagement position, and a first cam surface 17*c* and a second surface 17*d* that are capable of holding the first engagement pin 33*a*. The guide surface 17*a* is formed at a position opposite the first engagement pin 33*a* positioned at the initial position, and gradually guides the first engagement pin 33*a* from an inlet of the first engagement groove 41 to an interior of the first engagement groove 41 against the urging force of the first return spring 24. The introduction surface 17*b* is continuously formed with the guide surface 17*a*.

As illustrated in FIG. 7C, the first cam surface 17*c* is formed along a turning locus of a first point 42 (the point from the support pin 37 by a radius R1) on the first engagement pin nearest to the support pin 37. That is, the first cam surface 17*c* is formed in an arcuate shape of the radius R1. The second cam surface 17*d* is formed in an arcuate shape allowing the first engagement pin 33*a* to enter between itself and the first cam surface 17*c*. Further, the second cam surface 17*d* is formed in a tapered shape in an urging direction of the first return spring 24 with respect to the first cam surface 17*c* so as to allow contact with a second point 43 (the point from the support pin 37 by a radius R2) on the opposite side of the first point 42 with respect to the center axis 33*b* of the first engagement pin 33*a*. In other words, the second cam surface 17*d* is formed so as to cross the arc of the radius R2 at one point. According to the present exemplary embodiment, the engagement position of the first engagement pin 33*a* and the first cam surface 17*c* and that of the first engagement pin 33*a* and the second cam surface 17*d* are slightly displaced in the urging direction of the first return spring 24 with respect to an inserting direction of the first locking unit 18.

The second pin housing 20 has a second insertion hole 50 as a recess portion allowing insertion of the second engagement block 29, and a second engagement groove 51 as an engagement groove for engaging with the second engagement pin 34*a*. The second insertion hole 50 is formed so as to provide a clearance of (n−m) in the width direction y of FIG. 4B with respect to the second engagement block 29. According to the present exemplary embodiment, a width of the second insertion hole 50 is formed to become n with respect to a width m of the second engagement block 29. In this way, the connected portion 12 facilitates alignment of the connecting portion 11 and the connected portion 12 at the time of connecting operation by providing clearance for the insertion hole 50 for the second engagement block 29. The second engagement groove 51 is formed in lateral symmetry with respect to the first engagement groove 41, so that a detailed description thereof will be omitted.

Next, the operation of connecting the connecting portion 11 and the connected portion 12, configured as described above, will be described with reference to FIGS. 8A, 8B, 8C, and 8D. Here, the operation of engaging the first engagement pin 33*a* of the first rotation arm 33 with the first pin housing 17 will be described. FIGS. 8A, 8B, 8C, and 8D are diagrams for illustrating the operation of engaging the first engagement pin 33*a* with the first pin housing 17 according to the first exemplary embodiment.

Figure 8A:
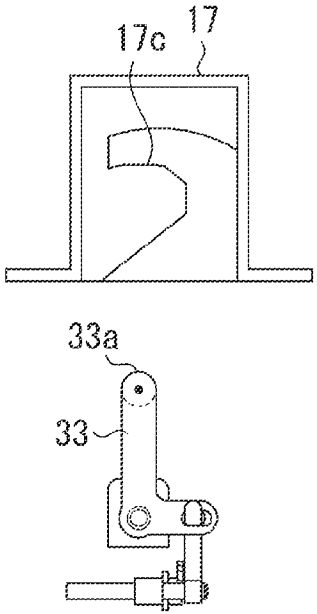
FIGS. 8A, 8B, 8C, and 8D are diagrams for illustrating an engagement operation of a first engagement pin and the first pin housing according to the first exemplary embodiment.
Figure 8B:
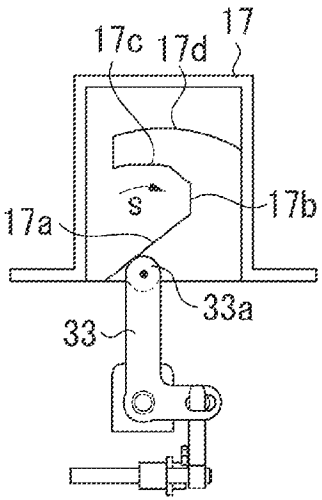

As illustrated in FIG. 8A, when the finisher 500 moves in the connecting direction (direction B illustrated in FIG. 2A) along the guide rail 13, the first engagement pin 33*a* positioned at the initial position approaches the guide surface 17*a* of the first engagement groove 41. As illustrated in FIG. 8B, when the first engagement pin 33*a* comes into contact with the guide surface 17*a* and the finisher 500 further moves in the connecting direction, the first engagement pin 33*a* is pushed by the guide surface 17*a*, and the first rotation arm 33 rotates in the direction of the arrow r against the urging force of the first return spring 24. At this time, the first engagement pin 33*a* moves into the interior of the first pin housing 17 along the first guide surface 17*a* while rotating.

Figure 8C:
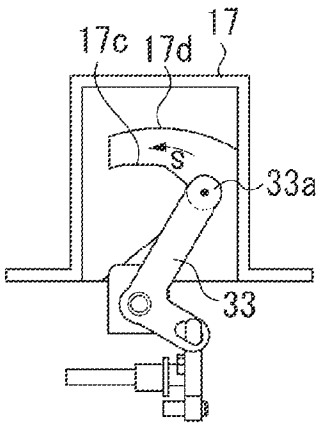

As illustrated in FIG. 8C, when the first engagement pin 33*a* reaches the introduction surface 17*b* and the finisher 500 further moves in the connecting direction, the first rotation arm 33 rotates in the direction of the arrow s (predetermined rotational direction) along the first cam surface 17*c* by the urging force of the first return spring 24.

Figure 8D:
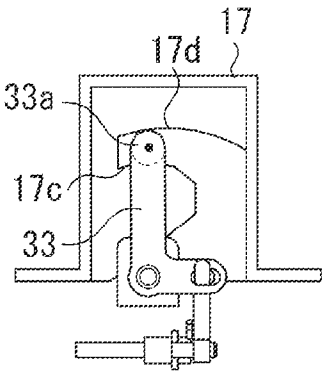

As illustrated in FIG. 8D, when the first engagement pin 33*a* comes into contact with the second cam surface 17*d*, the rotation in the direction of the arrow s of the first rotation arm 33 is stopped, and the first engagement pin 33*a* is fixed in position by being held between the first cam surface 17*c* and the second cam surface 17*d*. At this time, the first engagement pin 33*a* is firmly fixed in position due to wedge effect generated by the first cam surface 17*c* and the second cam surface 17*d*.

When the connection between the connecting portion 11 and the connected portion 12 is released, the releasing lever is rotated in the direction of the arrow p as illustrated in FIG. 6. Then, the first rotation arm 33 rotates in the direction of the arrow r (the direction opposite the urging direction). As a result, the first engagement pin 33*a* moves along the cam surface 17*c*, and the connection between the connecting portion 11 and the connected portion 12 is released.

As described above, the multifunction peripheral 100 according to the first exemplary embodiment is fixed in position in a manner where the first engagement pin 33*a* and the second engagement pin 34*a* are held between the first cam surface 17*c* and the second cam surface 17*d*. That is, the first engagement pin 33*a* and the second engagement pin 34*a* are respectively fixed at two positions of the front and the rear of the inserting direction in the first engagement groove 41 and the second engagement groove 51. Thus, sheet delivery can be prevented from becoming unstable due to play or clearance in the connection mechanism after the connection of the printer 110 and the finisher 500. As a result, deterioration in the precision of the post-processing by the finisher 500, such as punching or stapling, can be prevented.

Further, the first cam surface 17*c* is formed in an arcuate shape along the turning locus of the first point 42, and the second cam surface 17*d* is formed so as to come into contact with the second point 43. Thus, a wedge effect can be generated when the first engagement pin 33*a* and the second engagement pin 34*a* are held between the first cam surface 17*c* and the second cam surface 17*d*. As a result, the printer 110 and the finisher 500 can be firmly connected to each other. Therefore, occurrence of play can be prevented.

Further, the first engagement pin 33*a* is formed by a roller member rotatable on the first rotation arm 33, and the second engagement pin 34*a* is also formed by a roller member rotatable on the second rotation arm 34. Thus, resistance can be reduced when moving along the guide surface 17*a*, the introduction surface 17*b*, and the first cam surface 17*c*. As a result, the first engagement pin 33*a* and the second engagement pin 34*a* can smoothly move, and an unnecessary load can be prevented from generating in the first rotation arm 33, the second rotation arm 34, the first engagement groove 41, and the second engagement groove 51.

Figure 9A:
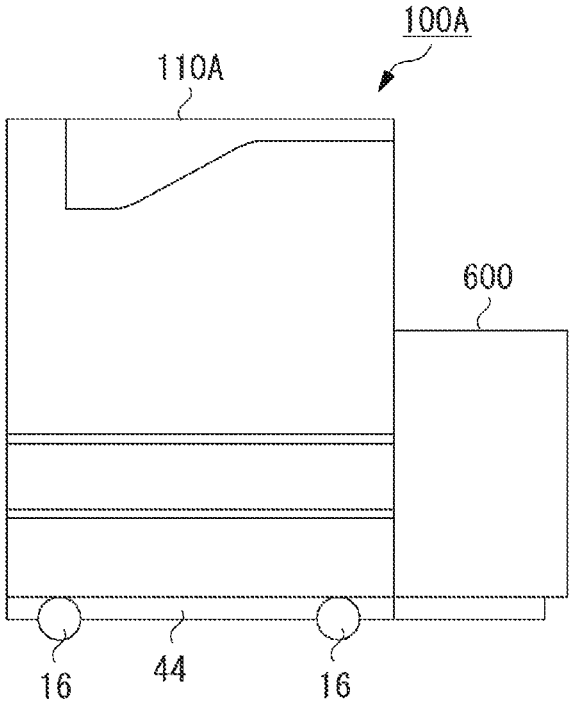
FIGS. 9A and 9B are diagrams schematically illustrating the overall structure of a multifunction peripheral according to a second exemplary embodiment.
Figure 9B:
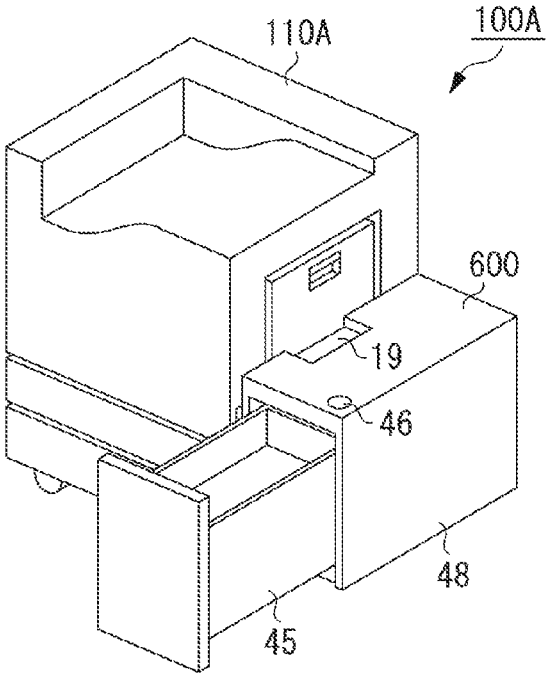
Figure 10A:
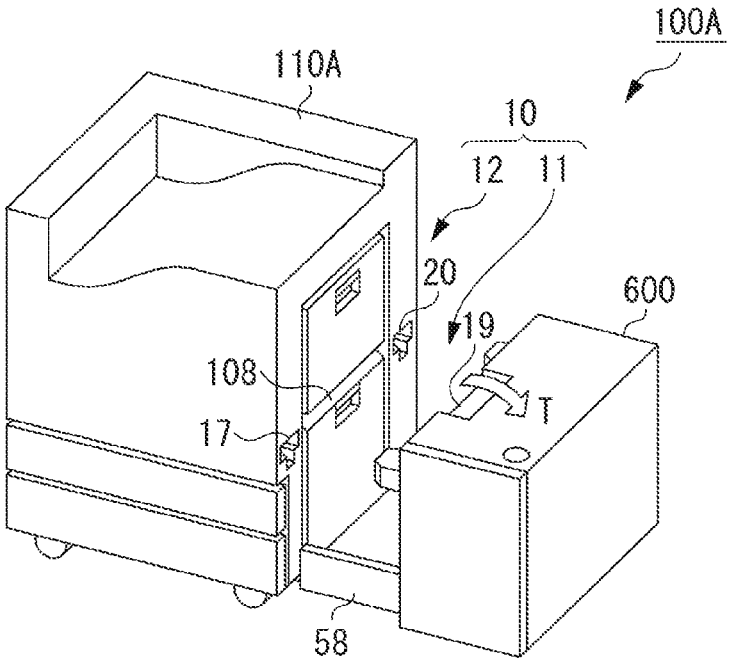
FIGS. 10A and 10B are perspective views schematically illustrating a state in which a feeding deck is separated from a printer according to the second exemplary embodiment.
Figure 10B:
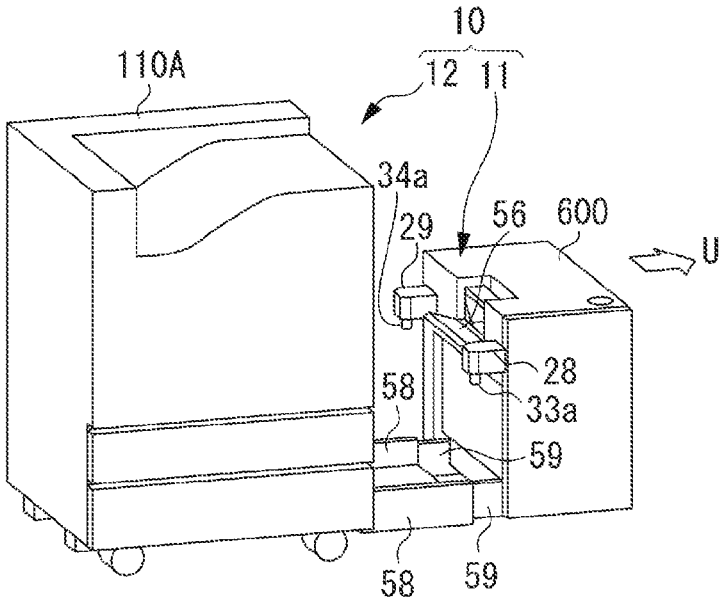

Next, a multifunction peripheral 100A according to a second exemplary embodiment of the present invention will be described with reference to FIGS. 9A, 9B, 10A, and 10B. The multifunction peripheral 100A according to the second exemplary embodiment differs from the multifunction peripheral 100 according to the first exemplary embodiment in that a feeding deck is connected to the printer. According to the second exemplary embodiment, a feeding deck 600 connected to a printer 110A is mainly described for the difference from the first exemplary embodiment. The components that are of the same configuration as those of the first exemplary embodiment will be indicated by the same reference numerals, with a description thereof being omitted. FIGS. 9A and 9B are diagrams schematically illustrating the overall construction of the multifunction peripheral 100A according to the second exemplary embodiment. FIGS. 10A and 10B are perspective views schematically illustrating a state in which the feeding deck 600 has been separated from the printer 110A according to the second exemplary embodiment.

As illustrated in FIGS. 9A and 9B, the multifunction peripheral 100A includes the printer 110A serving as the image forming apparatus main body for forming images on sheets, and the feeding deck 600 serving as a sheet feeding apparatus (the connected apparatus) capable of feeding a large amount of sheets to the printer 110A. The feeding deck 600 is detachably connected to the printer 110A by a connection mechanism 10, and can be used as an option with respect to the printer 110A, which can also be used singly. As illustrated in FIGS. 10A and 10B, according to the present exemplary embodiment, a connecting portion 11 is provided on the feeding deck 600, and a connected portion 12 is provided on the printer 110A. Since the connecting portion 11 and the connected portion 12 are of the same configuration as those of the first exemplary embodiment, a description thereof will be omitted.

The printer 110A includes a sheet feeding unit 101 for feeding sheets, an image forming unit 102 for forming images on the sheets, and a sheet receiving unit 108 for receiving the sheets fed from the feeding deck 600. The sheet receiving unit 108 is provided on the side surface of the printer 110A of the feeding deck 600 side for feeding the sheets fed from the feeding deck 600 to the image forming unit 102.

The sheet feeding deck 600 includes a sheet storage unit 45 capable of storing a large amount of sheets, a feeding deck main body 48 drawably accommodating the sheet storage unit 45, and a sheet discharge unit 56 for sending the sheets into the sheet receiving unit 108 of the printer 110. The feeding deck main body 48 includes an extraction button 46. When the extraction button 46 is depressed, a solenoid (not illustrated) releases a lock lever (not illustrated), and the sheet storage unit 45 is pushed out of the feeding deck main body 48 by a compression spring (not illustrated) (See FIG. 9B).

Further, the feeding deck 600 is connected to the printer 110A via a deck rail 44 connected to the bottom portion of the printer 110A, and the deck rail 44 includes a rail guide 58 and an extendable rail 59 stored in the rail guide 58.

Next, the releasing operation when releasing the connection between the printer 110A and the feeding deck 600 will be described with reference to FIGS. 10A and 10B. When a releasing lever 19 is rotated in the direction of an arrow T illustrated in FIG. 10A, a first engagement pin 33*a* engaged with a first pin housing 17 and a second engagement pin 34*a* engaged with a second pin housing 20 move to releasing positions. When the first engagement pin 33*a* and the second engagement pin 34*a* move to the releasing positions, the feeding deck 600 becomes separable from the printer 110A. When, in this state, a force is applied to the feeding deck 600 in the direction of an arrow U illustrated in FIG. 10B, the extendable rail 59 stored in the rail guide 58 is drawn out, and the feeding deck 600 moves in the direction of the arrow U. As a result, the printer 110A and the feeding deck 600 are separated from each other, and a jam handling process can be performed, for example, at the sheet receiving unit 108 and the sheet discharge unit 56.

As described above, the multifunction peripheral 100A according to the second exemplary embodiment employs the connection mechanism 10 for the connection between the printer 110A and the feeding deck 600. Thus, sheets can be fed in a stable manner from the feeding deck 600 to the printer 110A. As a result, deterioration in precision at image formation by the printer 110 can be prevented.

The above-described exemplary embodiments of the present invention should not be construed restrictively. Further, the effects of the exemplary embodiments of the present invention described above are only given as the most suitable effects provided by the present invention, which means the effects of the present invention are not restricted to those of the above-described exemplary embodiments.

For example, while the connecting portion 11 is provided on the finisher 500, and the connected portion 12 is provided on the printer 110 according to the first exemplary embodiment, the exemplary embodiment of the present invention should not be limited to the configuration. The connecting portion 11 may be provided on the printer 110, and the connected portion 12 may be provided on the finisher 500. Further, while the connecting portion 11 is provided on the feeding deck 600, and the connected portion 12 is provided on the printer 110A according to the second exemplary embodiment, the exemplary embodiment of the present invention should not be limited to the configuration. The connecting portion 11 may be provided on the printer 110A, and the connected portion 12 may be provided on the feeding deck 600.

Further, while the configuration according to the exemplary embodiments is described using the engagement groove 41 with the second cam surface 17*d* formed in an arcuate shape, the exemplary embodiments of the present invention should not be limited to the configuration. An engagement groove may include a second cam surface formed, for example, in a linear or spline shape.

Further, while the configuration according to the present exemplary embodiments is described using the connecting portion 11 including the first locking unit 18 and the second locking unit 21, and the connected portion 12 including the first pin housing 17 and the second pin housing 20, the exemplary embodiments of the present invention should not be limited to the configuration. The connecting portion may include one or a plurality of locking units. In this case, the connected portion has one or a plurality of pin housings.

According to the present exemplary embodiment, an engagement pin of a connecting portion is fixed in position by a first cam surface and a second cam surface of the connected portion, whereby apparatuses can be stably connected to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet post-processing apparatus for performing post-processing on a sheet on which images have been formed by an image forming apparatus, comprising:

a post-processing unit configured to perform post-processing on a sheet; and a connecting portion including a rotation arm rotatable about a rotation shaft at a first end of the rotation arm and, an urging unit configured to urge the rotation arm, the connecting portion being capable of being inserted integrally into a connected portion provided on the image forming apparatus, wherein the rotation arm includes an engagement pin provided on a second end opposite to the first end of the rotatable arm, wherein the connecting portion includes a case member configured to cover the rotation arm, the case member is configured to perform positioning, in a width direction intersecting an insertion direction of the connecting portion, of the connecting portion with respect to the connected portion, wherein the engagement pin is guided by a guiding portion provided in the connected portion, and wherein the engagement pin is configured to move along the guiding portion while the case member is inserted into the connected portion.

2. The sheet post-processing apparatus according to claim 1, wherein the guiding portion includes a first guide surface configured to move the engagement pin against an urging force of the urging unit and a second guide surface configured to move the engagement pin using the urging unit, and wherein the second guide surface is located downstream of the first guide surface in the insertion direction of the connecting portion.

3. The sheet post-processing apparatus according to claim 2, wherein the first guide surface is formed, centered on the rotation shaft, in an arcuate shape, and wherein the second guide surface is formed, centered on the rotation shaft, in an arcuate shape.

4. The sheet post-processing apparatus according to claim 1, wherein the case member covers the entirety of the rotation arm.

5. The sheet post-processing apparatus according to claim 1, wherein the engagement pin is rotatably supported by the rotation arm.

6. The sheet post-processing apparatus according to claim 1, further comprising a releasing lever configured to release the connection between the engagement pin and the connected portion by rotating the rotation arm in a direction opposite the urging direction of the urging unit.

7. The sheet post-processing apparatus according to claim 1, wherein the connecting portion includes a first connecting portion and a second connecting portion that are located apart from each other in the width direction, and wherein each of the first connecting portion and a second connecting portion includes the rotation arm, the engagement pin and the urging unit.

8. The sheet post-processing apparatus according to claim 7, wherein an urging direction of the urging unit included in the first connecting portion and an urging direction of the urging unit included in the second connecting portion are opposite to each other.

9. An image forming apparatus comprising:

an image forming apparatus main body configured to form an image on a sheet;

a sheet post-processing apparatus configured to perform a predetermined post-processing operation on a plurality of sheets on which images have been formed by the image forming apparatus main body; and a sheet post-processing apparatus as claimed in claim 1 configured to connect to the image forming apparatus.

10. A sheet post-processing apparatus for performing post-processing on a sheet on which images have been formed by an image forming apparatus, comprising:

a post-processing unit configured to perform post-processing on a sheet; and a connecting portion including a rotation arm rotatable about a rotation shaft at a first end of the rotation arm, an urging unit configured to urge the rotation arm and an engagement pin provided on a second end opposite to the first end of the rotation arm, and capable of being inserted into a connected portion provided in the image forming apparatus, wherein the connecting portion includes a positioning member configured to perform positioning, in a width direction intersecting an insertion direction of the connecting portion, of the connecting portion with respect to the connected portion, wherein the engagement pin is guided by a guiding portion provided in the connected portion, wherein the engagement pin is configured to move along the guiding portion while the positioning member is inserted into the connected portion, wherein the connecting portion includes a first connecting portion and a second connecting portion that are located apart from each other in the width direction, wherein each of the first connecting portion and a second connecting portion includes the rotation arm, the engagement pin and the urging unit, and wherein an urging direction of the urging unit included in the first connecting portion and an urging direction of the urging unit included in the second connecting portion are opposite to each other.

11. The sheet post-processing apparatus according to claim 10, wherein the guiding portion includes a first guide surface configured to move the engagement pin against an urging force of the urging unit and a second guide surface configured to move the engagement pin using the urging unit, and wherein the second guide surface is located downstream of the first guide surface in the insertion direction of the connecting portion.

12. The sheet post-processing apparatus according to claim 11, wherein the first guide surface is formed, centered on the rotation shaft, in an arcuate shape, and wherein the second guide surface is formed, centered on the rotation shaft, in an arcuate shape.

13. The sheet post-processing apparatus according to claim 10, wherein the positioning member is configured to cover the rotation arm.

14. The sheet post-processing apparatus according to claim 10, wherein the engagement pin is rotatably supported by the rotation arm.

15. The sheet post-processing apparatus according to claim 10, further comprising a releasing lever configured to release the connection between the engagement pin and the connected portion by rotating the rotation arm in a direction opposite the urging direction of the urging unit.

16. An image forming apparatus comprising:

an image forming apparatus main body configured to form an image on a sheet;

a sheet post-processing apparatus configured to perform a predetermined post-processing operation on a plurality of sheets on which images have been formed by the image forming apparatus main body; and a sheet post-processing apparatus as claimed in claim 10 configured to connect to the image forming apparatus.

* * * * *